US010414527B2

(12) United States Patent
Chen

(10) Patent No.: US 10,414,527 B2
(45) Date of Patent: Sep. 17, 2019

(54) POWER DEVICE FOR PNEUMATIC PACKING TOOL

(71) Applicant: Hsiu-Man Yu Chen, Taichung (TW)

(72) Inventor: Hsiu-Man Yu Chen, Taichung (TW)

( * ) Notice: Subject to any disclaimer, the term of this patent is extended or adjusted under 35 U.S.C. 154(b) by 361 days.

(21) Appl. No.: 15/415,319

(22) Filed: Jan. 25, 2017

(65) Prior Publication Data

US 2018/0208340 A1 Jul. 26, 2018

(51) Int. Cl.

| | |
|---|---|
| ***B65B 13/18*** | (2006.01) |
| ***F01C 13/02*** | (2006.01) |
| ***F01C 1/344*** | (2006.01) |
| ***B65B 13/02*** | (2006.01) |

(52) U.S. Cl.
CPC ..... *B65B 13/188* (2013.01); *F01C 1/3442* (2013.01); *F01C 13/02* (2013.01); *B65B 13/025* (2013.01)

(58) Field of Classification Search
CPC ..... B65B 13/188; B65B 13/22; B65B 13/24; B65B 13/025; F01C 13/02; F01C 1/3442
USPC ..... 100/32
See application file for complete search history.

(56) References Cited

U.S. PATENT DOCUMENTS

2013/0087053 A1* 4/2013 Yu Chen ..... B65B 13/22 100/29
2015/0344160 A1* 12/2015 Yu Chen ..... B65B 13/188 53/582

* cited by examiner

*Primary Examiner* — Shelley M Self
*Assistant Examiner* — Mohammed S. Alawadi
(74) *Attorney, Agent, or Firm* — Sinorica, LLC

(57) ABSTRACT

A power device for a pneumatic packing tool includes a gas delivery unit and a pneumatic unit. The gas delivery unit has an accommodation room, an air inlet, and air outlets. The accommodation room includes a turning block having an input passage. An expansion space is defined between the turning block and the accommodation room. The expansion space communicates with the air outlets. An outer circumferential side of the gas delivery unit is provided with a knob. A push rod is inserted in the knob and the turning block. The pneumatic unit has two through holes. Through the knob, the turning block is turned for the input passage to communicate with one of the through holes to set the direction of winding a belt quickly, and the gas flows from the other through hole to the expansion space to be expanded and exhausted to eliminate the noise.

8 Claims, 12 Drawing Sheets

POWER DEVICE FOR PNEUMATIC PACKING TOOL

FIELD OF THE INVENTION

The present invention relates to a power device, and more particularly to a power device for a pneumatic packing tool.

BACKGROUND OF THE INVENTION

A conventional power device for a pneumatic packing tool has a pneumatic motor. The pneumatic motor has an air inlet, an impeller, and an air outlet. When a high-pressure gas is inputted into the air inlet of the pneumatic packing tool, the impeller is brought to rotate and generate a mechanical force for tightening a packing belt so that an article can be packed quickly.

However, during the process of packing, since the pneumatic packing tool is inputted with a high-pressure gas, when the high-pressure gas is exhausted via the air outlet, a large amount of noise will be generated, which will affect the hearing of the user after a long period of time. Therefore, the air outlet is blocked with a fabric, a net or other material to achieve the purpose of noise reduction. But, this way reduces the output efficiency of the pneumatic packing tool. Moreover, the conventional pneumatic packing tool uses a turning valve to change the direction of the rotation of the pneumatic packing tool, which increases the complexity of production and operation. Accordingly, the inventor of the present invention has devoted himself based on his many years of practical experiences to solve these problems.

SUMMARY OF THE INVENTION

The primary object of the present invention is to provide a power device for a pneumatic packing tool, which can reduce the noise in use and change the direction of winding a packing belt.

In order to achieve the aforesaid object, the power device for a pneumatic packing tool of the present invention comprises a gas delivery unit and a pneumatic unit. The gas delivery unit has an accommodation room therein. The gas delivery unit has an air inlet and a plurality of air outlets which are in communication with the accommodation room. The accommodation room is provided with a turning block therein. The turning block has an input passage communicating with the air inlet. An expansion space is defined between the turning block and the accommodation room. The expansion space is in communication with the plurality of air outlets. An outer circumferential side of the gas delivery unit is provided with a knob. A push rod is provided and inserted in the knob and the turning block. The pneumatic unit includes a cylinder. The cylinder has a cylinder chamber therein. The cylinder chamber has two through holes corresponding to the input passage. An impeller is pivotally provided in the cylinder chamber. The impeller includes a rotating shaft. An end of the rotating shaft extends out of the cylinder chamber and has a drive toothed portion.

Thereby, through the knob, the turning block is turned to set the direction of rotation of the impeller and further to set the direction of rotation of the belt winding unit. The gas exhausted from the pneumatic unit expands in the expansion space so that the noise generated by exhaust can be eliminated.

DETAILED DESCRIPTION OF THE PREFERRED EMBODIMENTS

Embodiments of the present invention will now be described, by way of example only, with reference to the accompanying drawings.

Figure 1:
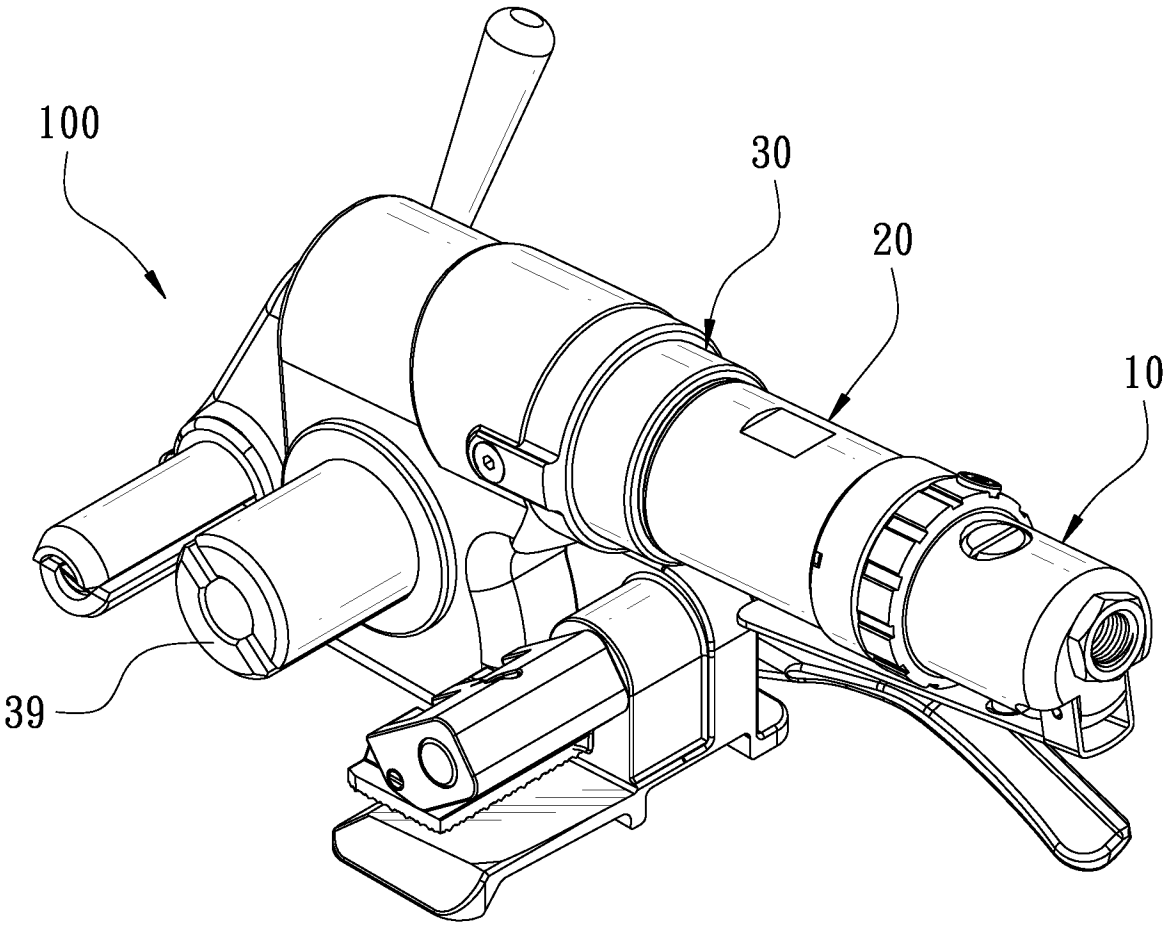
FIG. 1 is a perspective view of the present invention.
Figure 2:
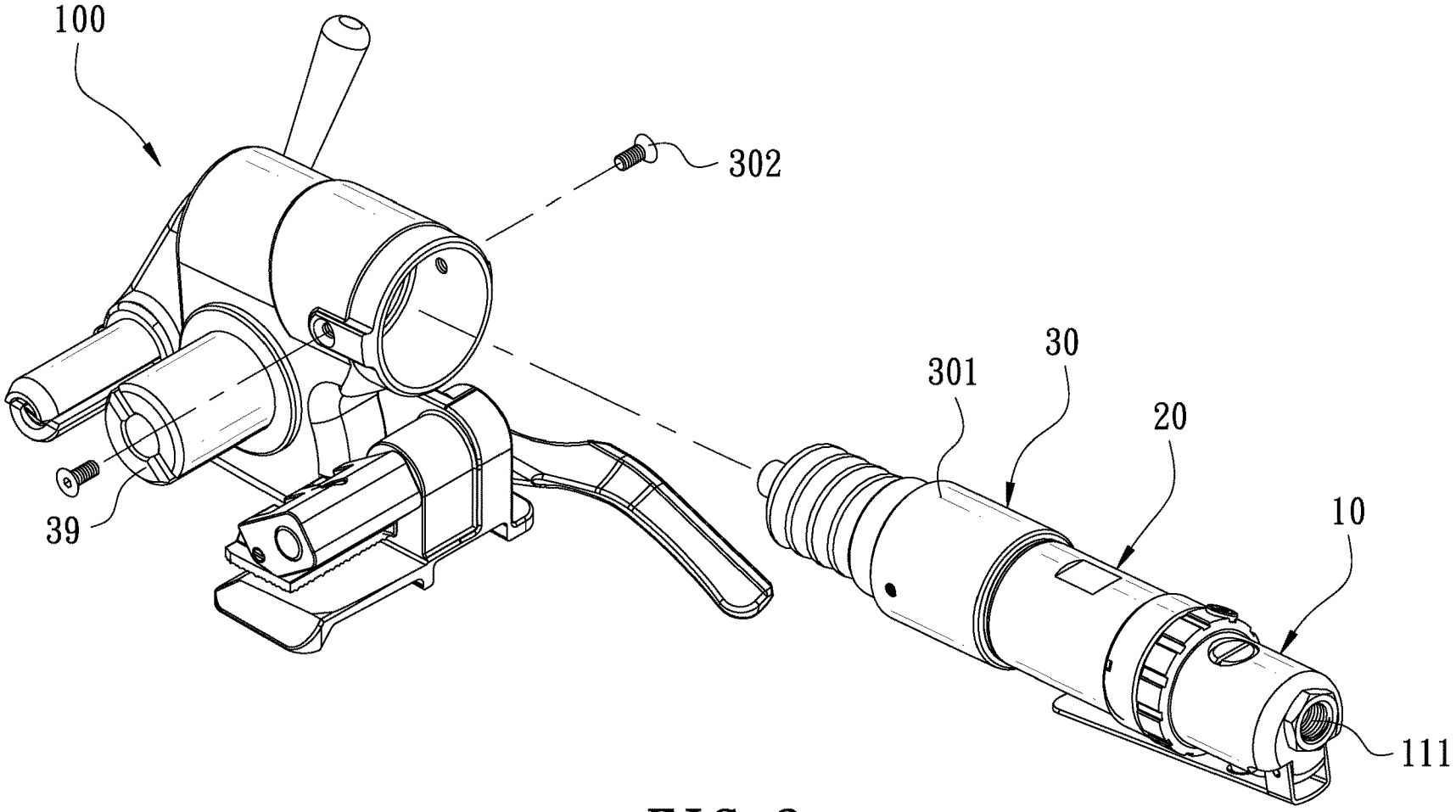
FIG. 2 is a partial exploded view of the present invention.
Figure 3:
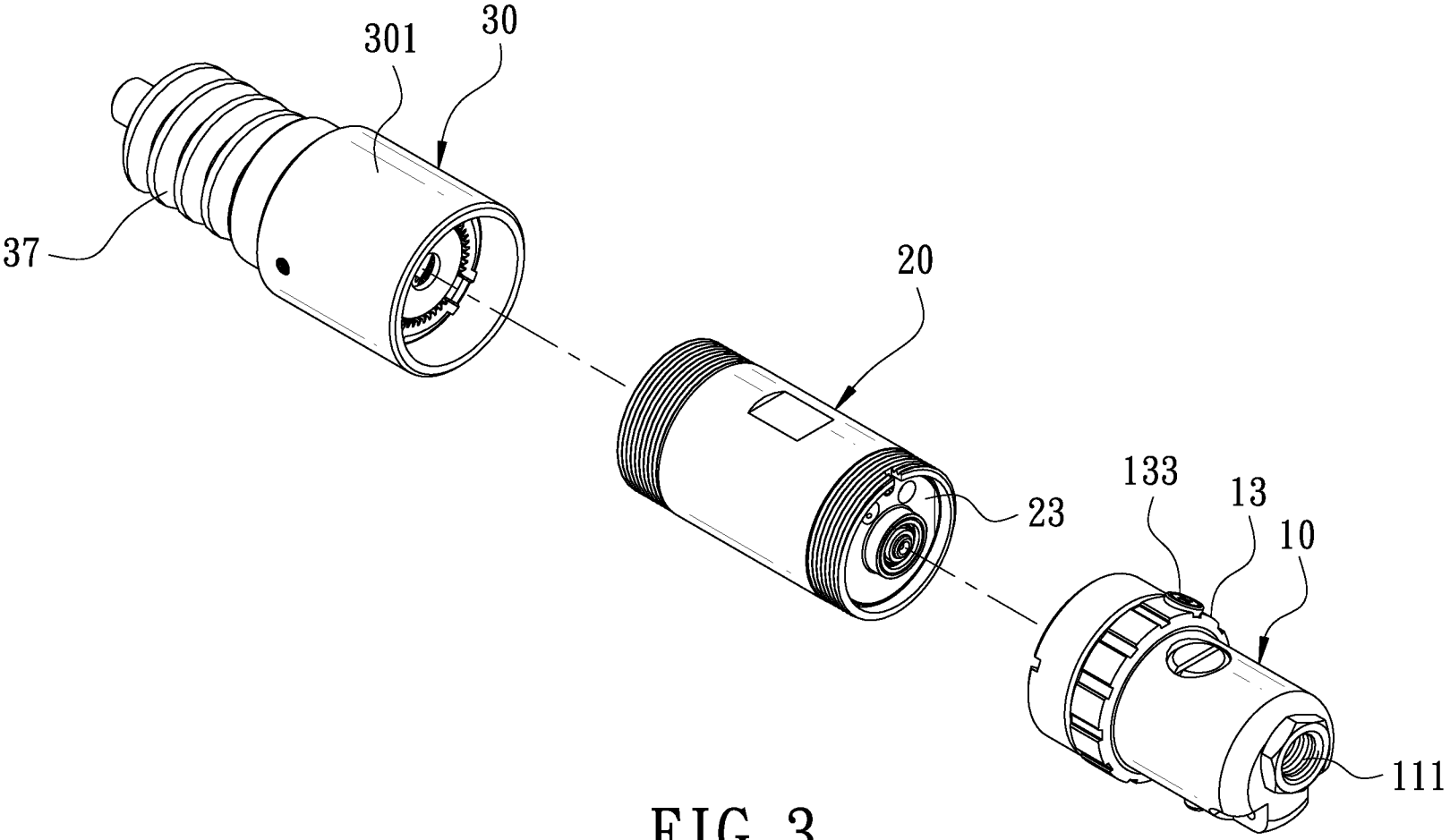
FIG. 3 is another partial exploded view of the present invention.

FIG. 1 is a perspective view of the present invention. FIG. 2 and FIG. 3 are partial exploded views of the present invention. The present invention discloses a power device for a pneumatic packing tool, mounted to a pneumatic packing tool 100, and comprises a gas delivery unit 10, a pneumatic unit 20, and a transmission unit 30.

Figure 4:
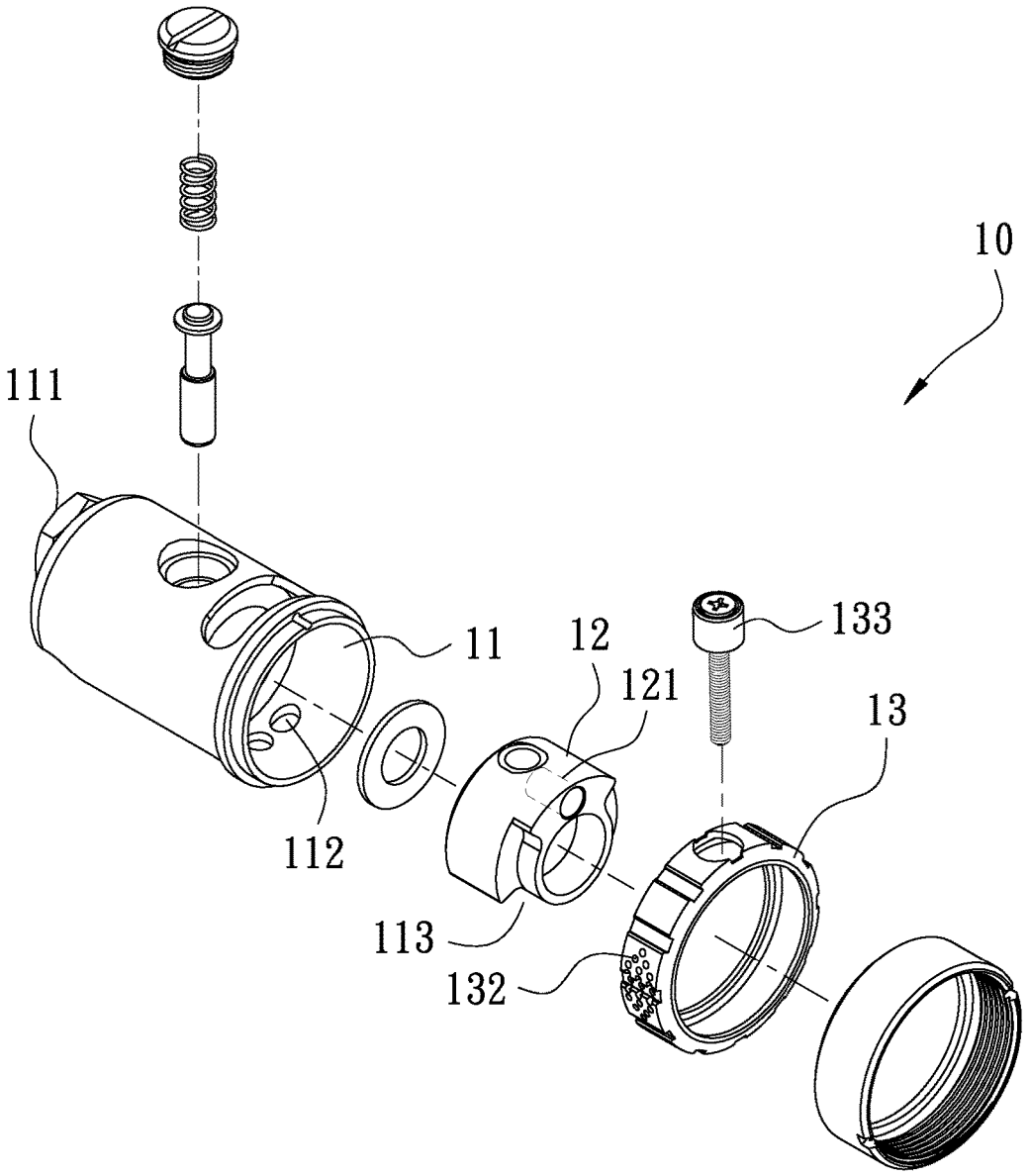
FIG. 4 is an exploded view of a gas delivery unit of the present invention.
Figure 11:
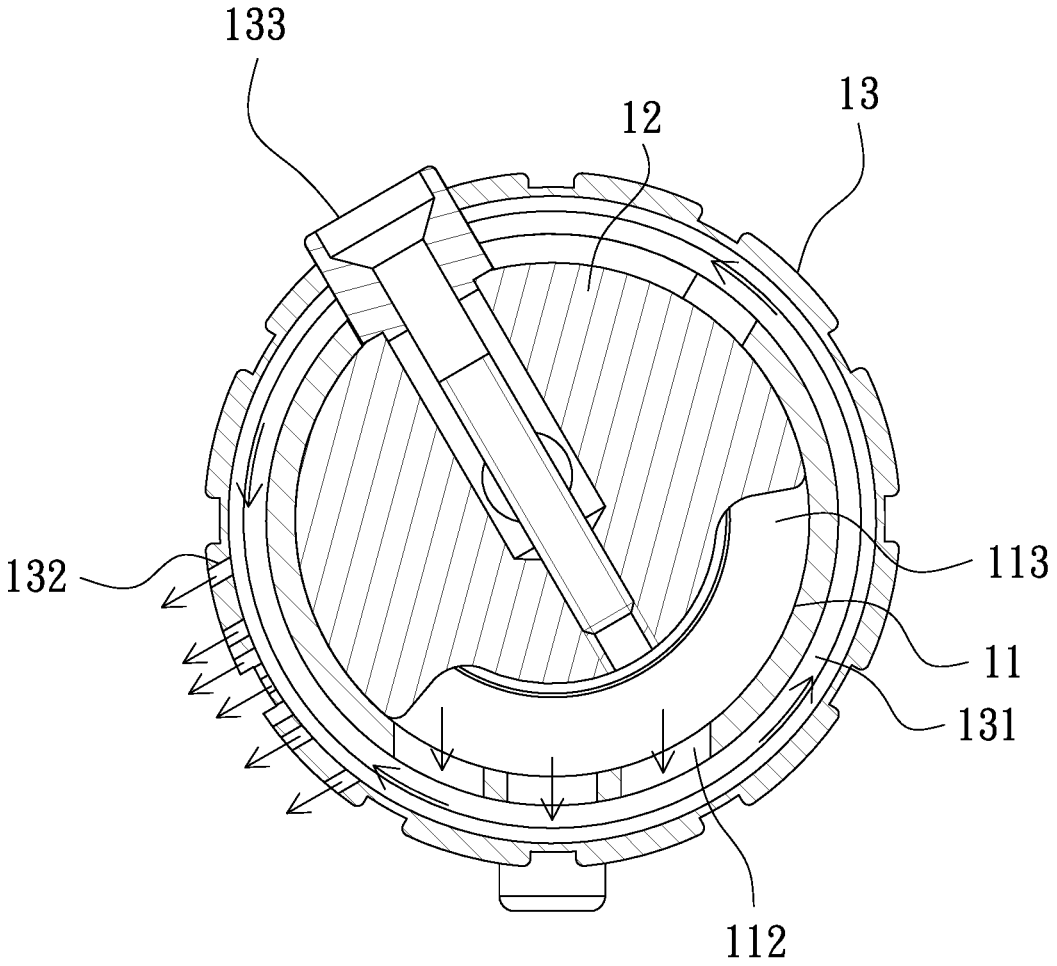
FIG. 11 is a sectional view taken along line 11-11 of FIG. 7.

Referring to FIG. 4, the gas delivery unit 10 has an accommodation room 11 therein. The gas delivery unit 10 has an air inlet 111 and a plurality of air outlets 112 which are in communication with the accommodation room 11. The accommodation room 11 is provided with a turning block 12 therein. The turning block 12 has an input passage 121 communicating with the air inlet 111. An expansion space 113 is defined between the turning block 12 and the accommodation room 11. The expansion space 113 is in communication with the plurality of air outlets 112. An outer circumferential side of the gas delivery unit 10 is provided with a knob 13. The knob 13 is adapted to cover the plurality of air outlets 112. The knob 13 has an expansion passage 131 communicating with the plurality of air outlets 112, as shown in FIG. 11. The knob 13 has a plurality of exhaust holes 132 communicating with the expansion passage 131. A push rod 133 is provided and inserted in the knob 13 and the turning block 12.

Figure 5:
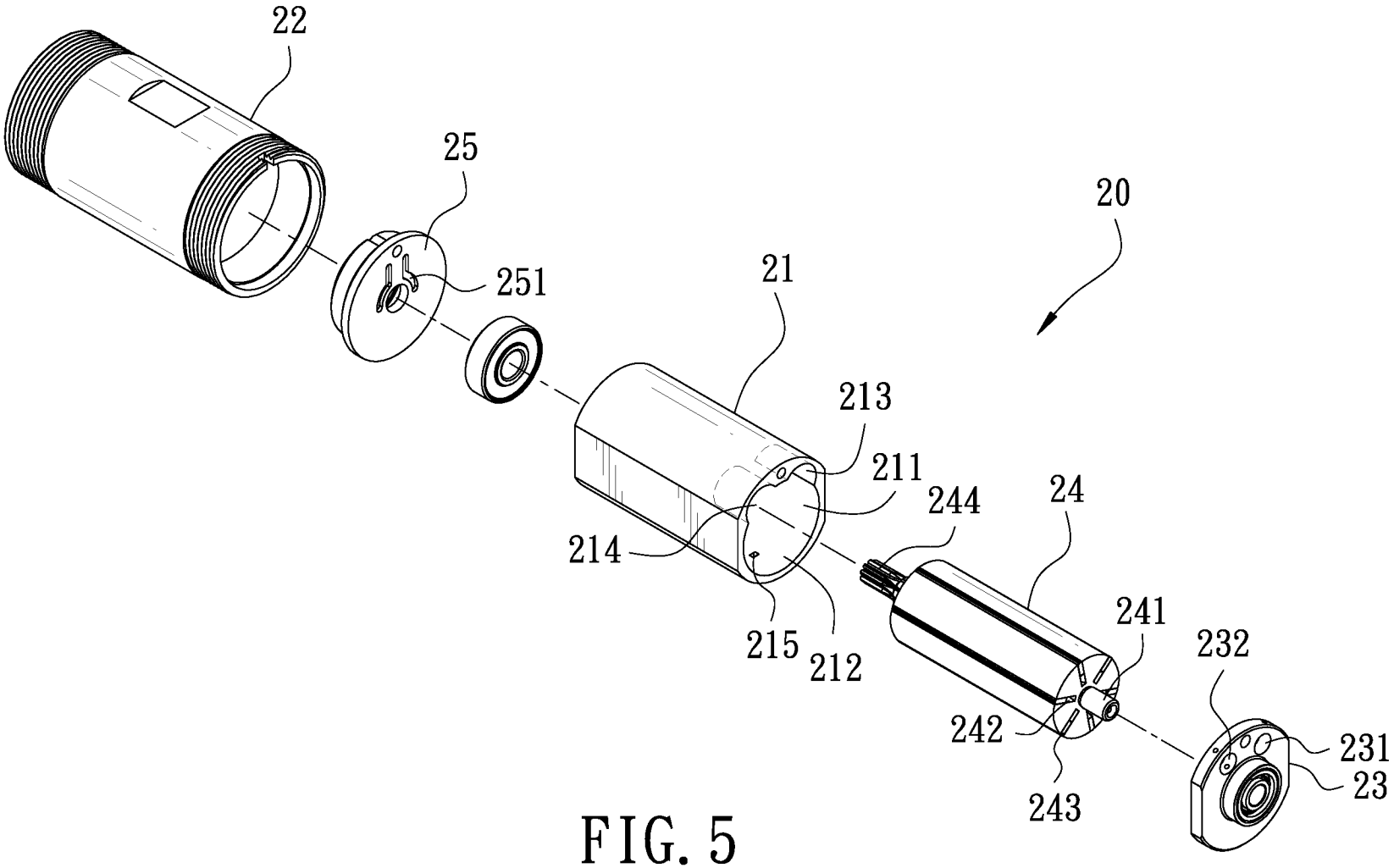
FIG. 5 is an exploded view of a pneumatic unit of the present invention.
Figure 8:
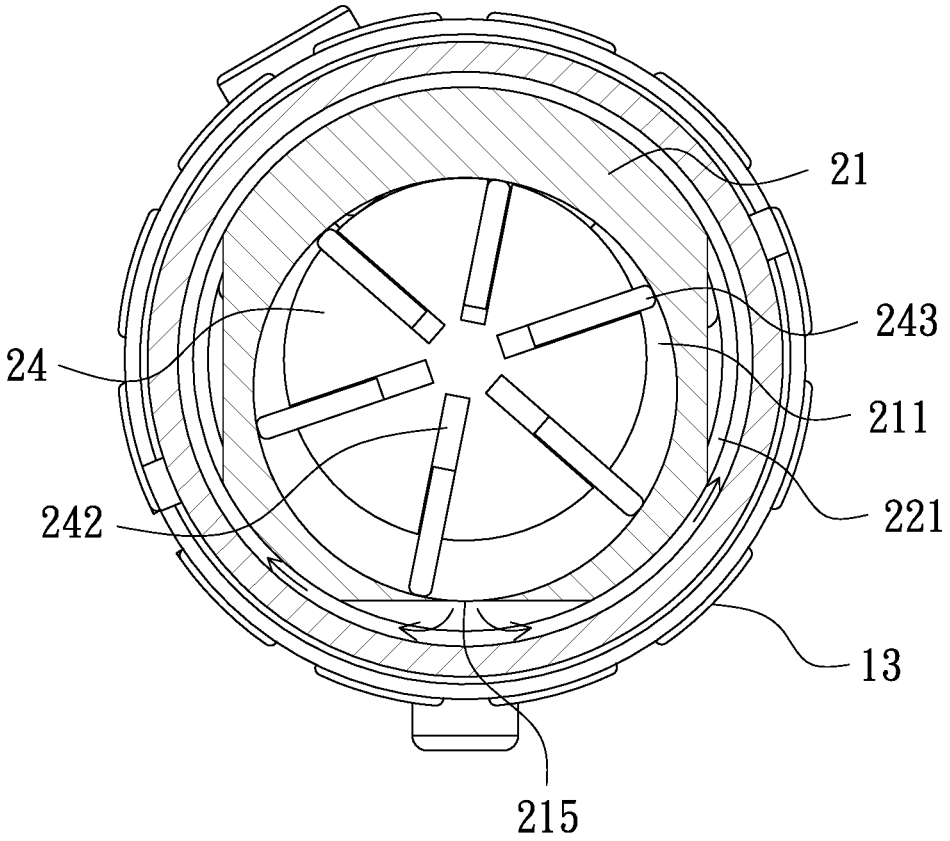
FIG. 8 is a sectional view taken along line 8-8 of FIG. 7.
Figure 9:
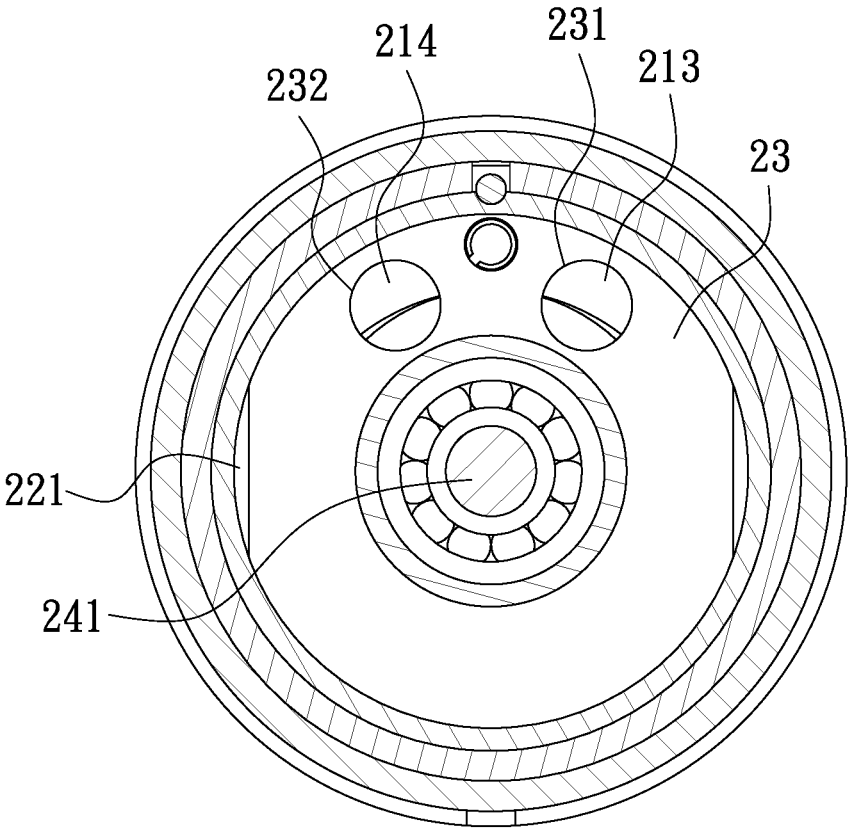
FIG. 9 is a sectional view taken along line 9-9 of FIG. 7.
Figure 10:
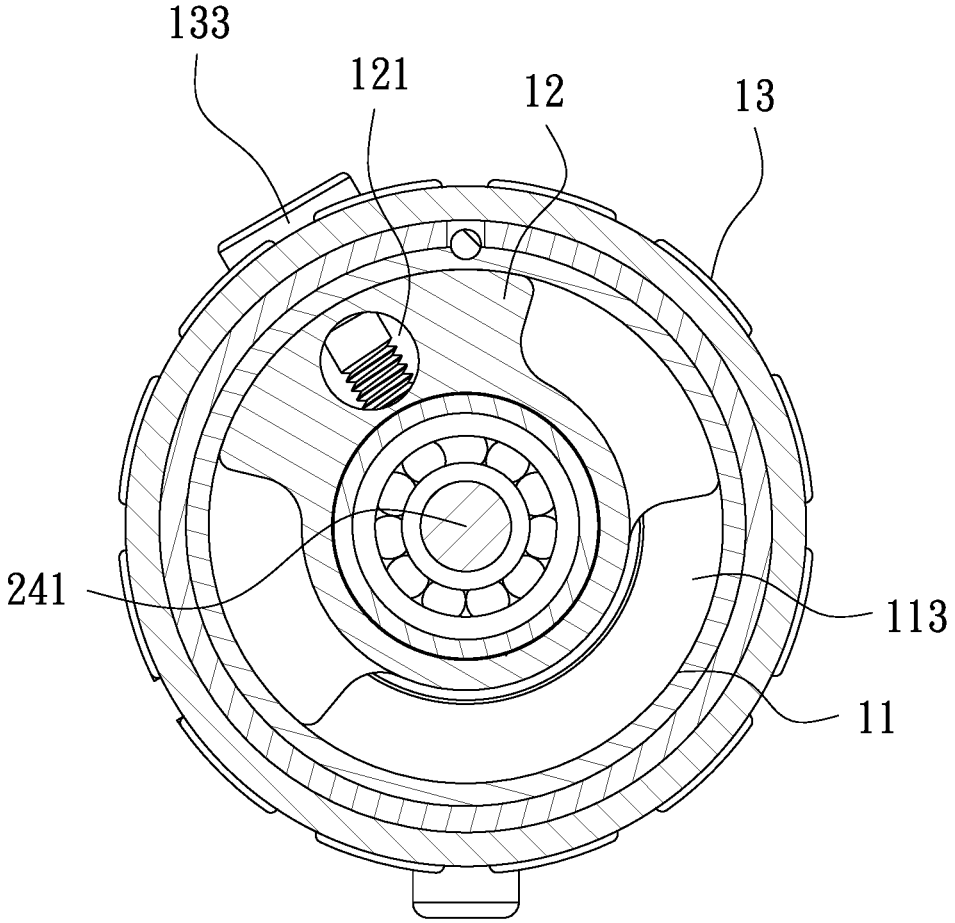
FIG. 10 is a sectional view taken along line 10-10 of FIG. 7.

Referring to FIG. 5, the pneumatic unit 20 includes a cylinder 21. The cylinder 21 is disposed in a casing 22. An output passage 221 is defined between the casing 22 and the cylinder 21, and the output passage 221 is in communication with the expansion space 113, as shown in FIGS. 4-5 and 8-10. The cylinder 21 has a cylinder chamber 211 therein. The cylinder chamber 211 has a circular cross-section. The cylinder chamber 211 has a first end and a second end each having an opening 212. The first end of the cylinder chamber 211 is provided with a first plate member 23. The first plate member 23 has two through holes 231, 232 corresponding to the input passage 121. The top of the inner wall of the cylinder chamber 21 has two guide recesses 213, 214 corresponding to the two through holes 231, 232, and the two through holes 231, 232 are in communication with the two guide recesses 213, 214, respectively. The bottom of the cylinder chamber 211 has a plurality of perforations 215. The perforations 215 are arranged along the axial direction of the cylinder chamber 211 and spaced a distance from one another so that the cylinder chamber 211 can communicate with the output passage 221. An impeller 24 is pivotally provided in the cylinder chamber 211. The impeller 24 includes a rotating shaft 241. The axis of the rotating shaft 241 is arranged eccentrically relative to the axis of the cylinder chamber 211. As shown in FIG. 8, the distance from the axis of the rotating shaft 241 to the top of the cylinder chamber 211 is less than the distance from the axis of the rotating shaft 241 to the bottom of the cylinder chamber 211. A circumferential side of the rotating shaft 241 is formed with a plurality of grooves 242. The plurality of grooves 242 are each provided with a blade 243. An end of the rotating shaft 241 extends out of a second plate member 25 and has a drive toothed portion 244. The second plate member 25 is configured to cover the second end of the cylinder chamber 211. The second plate member 25 has two connecting grooves 251 beside the rotating shaft 241.

Figure 6:
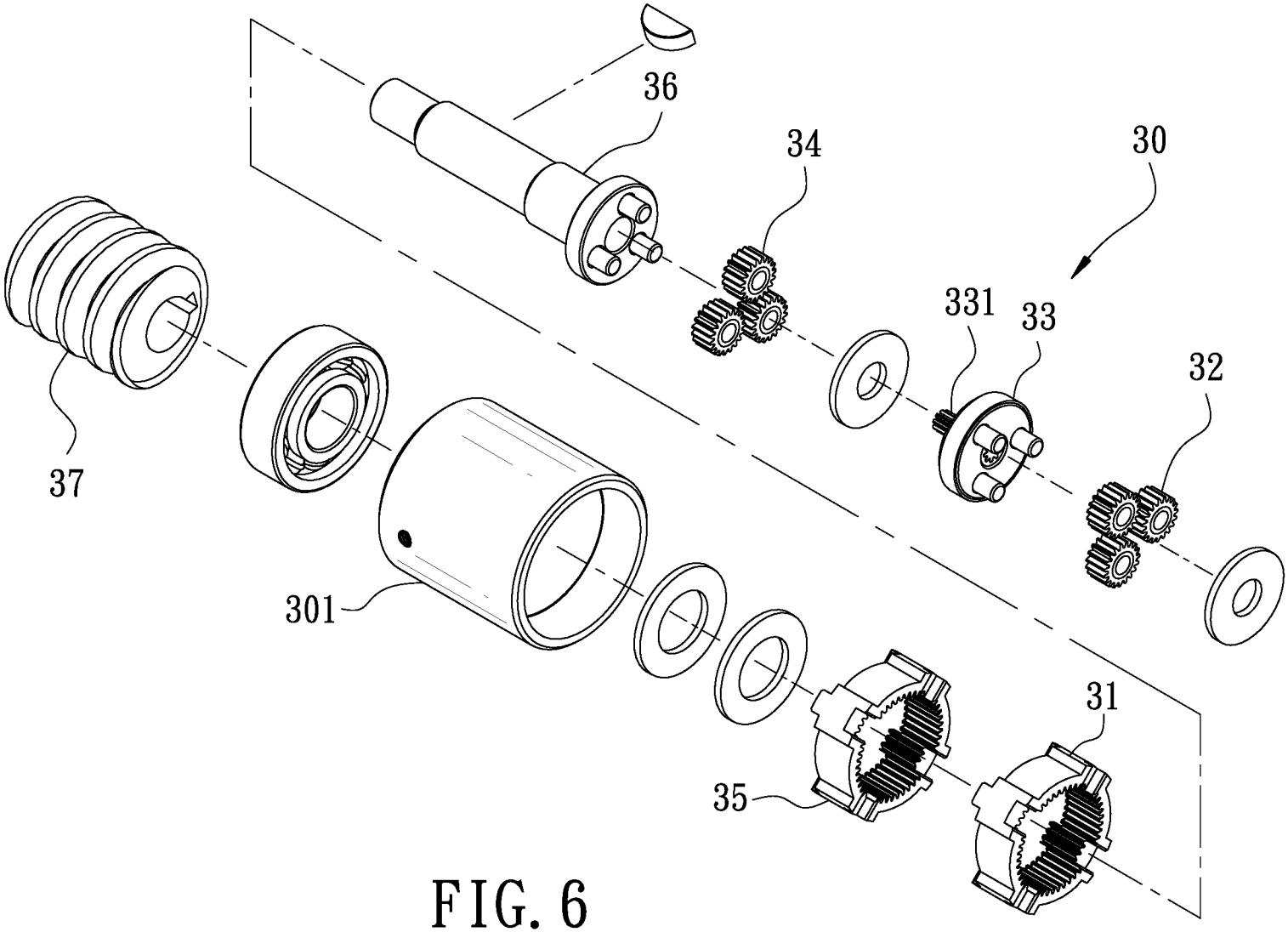
FIG. 6 is an exploded view of a transmission unit of the present invention.
Figure 7:
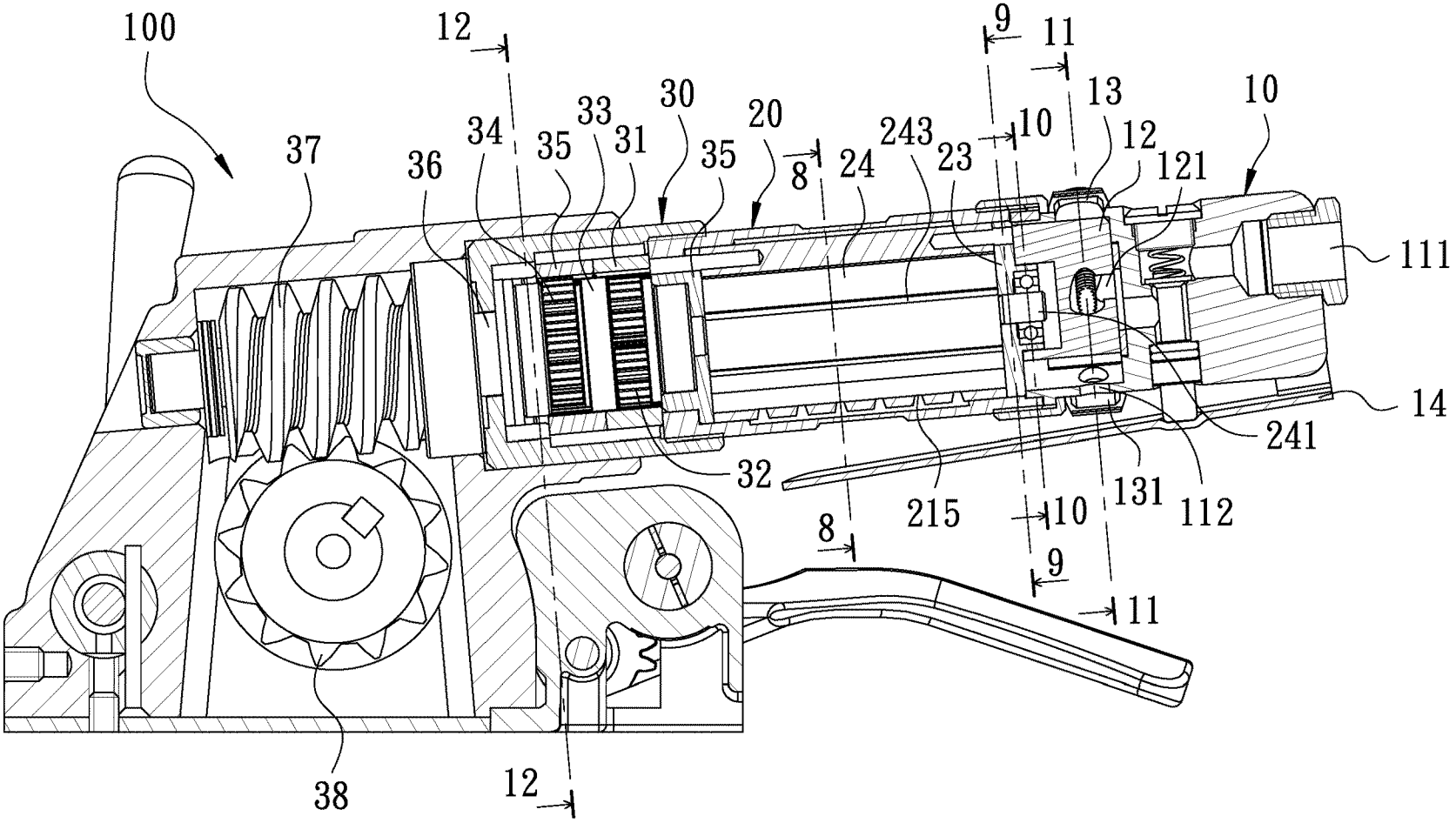
FIG. 7 is a longitudinal sectional view of the present invention.
Figure 12:
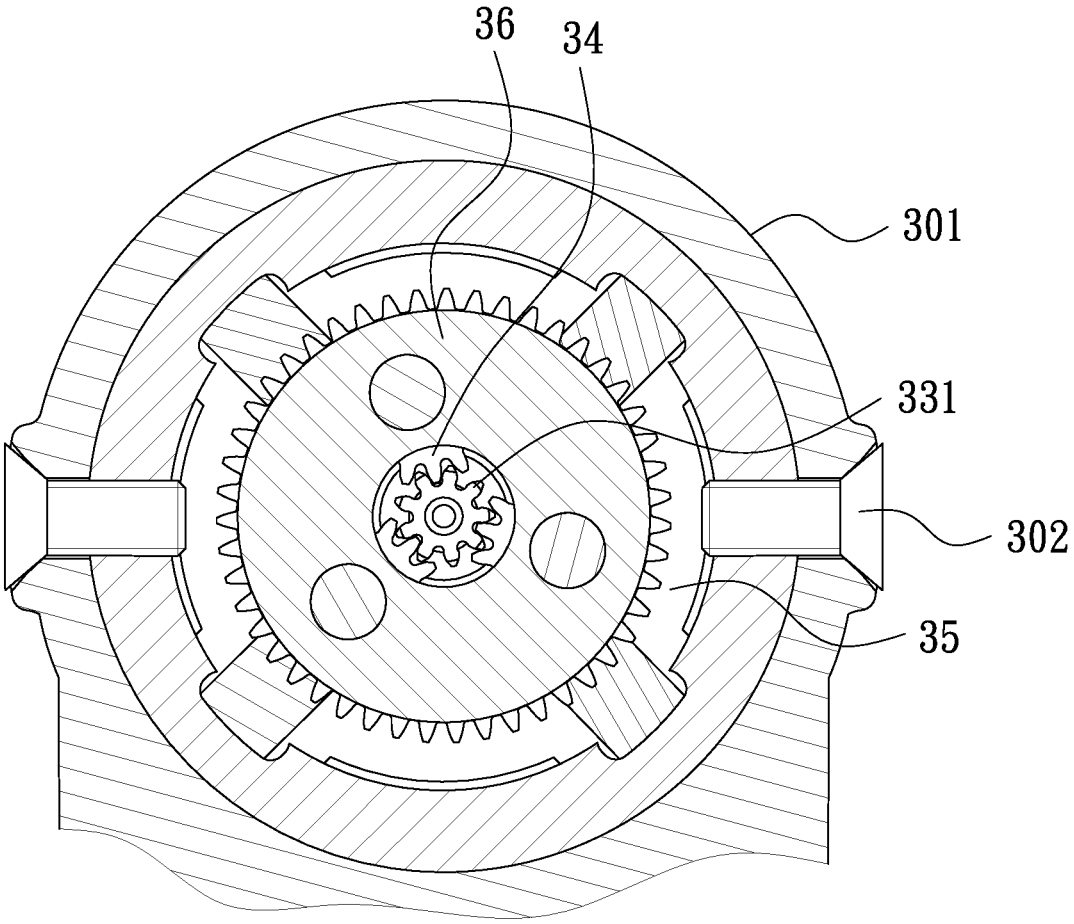
FIG. 12 is a sectional view taken along line 12-12 of FIG. 7.

Referring to FIG. 6, the transmission unit 30 has a housing 301 connected with the casing 22 of the pneumatic unit 20. The housing 301 is provided with two screws 302 for locking the pneumatic packing tool 100. The two screws 302 are socket head cap screws. The two screws 302 are perpendicular to the axis of the transmission unit 30, as shown in FIG. 12. The transmission unit 30 includes a first ring gear 31. The inner annular wall of the first ring gear 31 meshes with a plurality of first planetary gears 32. The plurality of first planetary gears 32 mesh with the drive toothed portion 244. The plurality of first planetary gears 32 are connected to one side of an output gear 33. Another side of the output gear 33 is provided with a driven toothed portion 331. The driven toothed portion 331 meshes with a plurality of second planetary gears 34. The plurality of second planetary gears 34 mesh with the inner annular wall of a second ring gear 35. The plurality of second planetary gears 34 are connected to one side of a worm shaft 36. Another side of the worm shaft 36 is connected to a worm 37. A circumferential side of the worm 37 is connected with one side of a worm gear 38, as shown in FIG. 7. Another side of the worm gear 38 is connected with a belt winding unit 39, as shown in FIG. 1.

Referring to FIG. 7, in cooperation with FIGS. 4-6, first, the user sets the knob 13 and rotates the knob 13 to turn the turning block 12 synchronously, such that the input passage 121 of the turning block 12 is in communication with the through hole 231 of the first plate member 23 and the through hole 231 is in communication with the expansion space 131 to set the impeller 24 to be rotated clockwise. When the input passage 121 is in communication with the through hole 232, the impeller 24 is rotated counterclockwise. After a packing belt is wound around an article to be packed, the packing belt is inserted through the belt winding unit 39. A high-pressure gas is inputted into the air inlet 111. A press plate 14 is pressed, and the gas flows into the pneumatic unit 20 via the input passage 121. At this time, the gas enters the cylinder chamber 211 through the through hole 231 and the guide recess 213, and the gas pushes the blades 243 to rotate the impeller 24 about the rotating shaft 241 as shown in FIG. 8. The blades 243 are forced out of the grooves 242 by gravity and centrifugal forces and against the inner peripheral wall of the cylinder chamber 211. As shown in FIGS. 4-5 and 8-10, a portion of the gas flows into the expansion space 113 from the perforations 215 through the output passage 221 while the other portion of the gas flows into the expansion space 113 from the guide recess 214 through the through hole 232when the gas flows through the bottom of the cylinder chamber 211, then the gas flows into the expansion passage 131 of the knob 13 via the air outlets 112, and finally the gas is exhausted via the plurality of exhaust holes 132.

Referring to FIG. 6 and FIG. 7, when the impeller 24 starts rotating, because the first ring gear 31 is fixed to the housing 301 and cannot be rotated, the drive toothed portion 244 of the impeller 24 drives the plurality of first planetary gears 32 to rotate simultaneously so that the plurality of first planetary gears 32 are moved along the inner toothed wall of the first ring gear 31, and the output gear 33 is rotated coaxially with the rotating shaft 241 of the impeller 24. Since the second ring gear 35 is fixed to the first ring gear 31 and cannot be rotated, the driven toothed portion 331 of the output gear 33 drives the plurality of second planetary gears 34 to rotate simultaneously so that the plurality of second planetary gears 34 are moved along the inner toothed wall of the second ring gear 35 to allow the worm shaft 36 to start rotating coaxially with the output gear 33 and to rotate the worm 37 to drive the worm gear 38 to turn the belt winding unit 39 so that the pneumatic packing tool 10 performs a packing operation.

It is worth mentioning that in the present invention the input passage 121 of the turning block 12 is to communicate with the through hole 231 or the through hole 223 of the first plate member 23 through the setting of the knob 13, and the other through hole is to communicate with the expansion space 131 to exhaust the gas so that the direction of the rotation of the impeller 24 can be quickly set and then the winding direction of the belt winding unit 39 can be set.

In the present invention, after the gas enters the cylinder chamber 211 through the guide recess 213, it flows to the chamber between two of the blades 243 to rotate the blades 243. The impeller 24 is rotated at an angle to extend the blades 243 by gravity and centrifugal forces. Because the axis of the rotating shaft 241 is eccentrically arranged relative to the axis of the cylinder chamber 211, the distance from the axis of the rotating shaft 241 to the top of the cylinder chamber 211 is less than the distance from the axis of the rotating shaft 241 to the bottom of the cylinder chamber 211, as shown in FIG. 8, so that the volume between every two of the blades 243 is not equal to another one, and the gas is expanded in the cylinder chamber 211 to lower the pressure. A portion of the gas flows into the expansion space 113 from the perforations 215 through the output passage 221 to be expanded again. The other portion of the gas flows into the expansion space 113 from the guide recess 214 through the through hole 232 to be expanded. After that, the gas flows into the expansion passage 131 of the knob 13 via the air outlets 112 to be further expanded. Finally, the expanded gas is exhausted via the plurality of exhaust holes 132. Thereby, the pressure of the gas can be reduced by multiple-expansion so that the noise generated by exhaust can be eliminated.

In the present invention, the second plate member 25 has the two connecting grooves 251. When the impeller 24 is rotated, a small portion of the gas flows to the chamber of another set of the blades to rotate the impeller 24 smoothly.

In the present invention, one end of the worm shaft 36 is connected with the plurality of second planetary gears 34, and the other end of the worm shaft 36 is connected with the worm 37. Compared to the conventional gearbox which uses a connecting shaft to connect the worm shaft, the present invention has a more direct connection way and reduces the difficulty and failure rate of the production and assembly.

In the present invention, the housing 301 and the pneumatic packing tool 100 are fastened with the two screws 302. The two screws 302 are socket head cap screws. The transmission unit 30 can be effectively positioned by the tapered locking and positioning feature. The two screws 302 are perpendicular to the axis of the transmission unit 30 so that the axial stress generated by the worm shaft 36 won't loosen the two screws 302 and the transmission unit 30 will not be retracted.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A power device for a pneumatic packing tool, mounted to a pneumatic packing tool, comprising:

a gas delivery unit, having an accommodation room therein, the gas delivery unit having an air inlet and a plurality of air outlets which are in communication with the accommodation room, the accommodation room being provided with a turning block therein, the turning block having an input passage communicating with the air inlet, an expansion space being defined between the turning block and the accommodation room, the expansion space being in communication with the plurality of air outlets, an outer circumferential side of the gas delivery unit being provided with a knob, a push rod being provided and inserted in the knob and the turning block;

a pneumatic unit, including a cylinder, the cylinder having a cylinder chamber therein, the cylinder chamber having two through holes corresponding to the input passage, an impeller being pivotally provided in the cylinder chamber, the impeller including a rotating shaft, an end of the rotating shaft extending out of the cylinder chamber and having a drive toothed portion; and a transmission unit, connected to the drive toothed portion, the transmission unit being connected with a belt winding unit.

2. The power device for a pneumatic packing tool, as claimed in claim 1, wherein the knob is adapted to cover the plurality of air outlets, the knob has an expansion passage communicating with the plurality of air outlets, and the knob further has a plurality of exhaust holes communicating with the expansion passage.

3. The power device for a pneumatic packing tool, as claimed in claim 2, wherein the cylinder is disposed in a casing, an output passage is defined between the casing and the cylinder, and the output passage is in communication with the expansion space, a bottom of the cylinder chamber has a plurality of perforations, and the perforations are arranged along an axial direction of the cylinder chamber and spaced a distance from one another so that the cylinder chamber communicates with the output passage.

4. The power device for a pneumatic packing tool, as claimed in claim 3, wherein a top of an inner wall of the cylinder chamber has two guide recesses corresponding to the two through holes, and the two through holes are in communication with the two guide recesses, respectively.

5. The power device for a pneumatic packing tool, as claimed in claim 1, wherein the cylinder chamber has a first end and a second end each having an opening, the first end of the cylinder chamber is provided with a first plate member, the first plate member has the two through holes corresponding to the input passage, the end of the rotating shaft extends out of a second plate member and has the drive toothed portion, the second plate member is configured to cover the second end of the cylinder chamber, and the second plate member has two connecting grooves beside the rotating shaft.

6. The power device for a pneumatic packing tool, as claimed in claim 1, wherein an axis of the rotating shaft is arranged eccentrically relative to an axis of the cylinder chamber, a distance from the axis of the rotating shaft to a top of the cylinder chamber is less than a distance from the axis of the rotating shaft to a bottom of the cylinder chamber, a circumferential side of the rotating shaft is formed with a plurality of grooves, and the plurality of grooves are each provided with a blade.

7. The power device for a pneumatic packing tool, as claimed in claim 1, wherein the transmission unit includes a first ring gear, an inner annular wall of the first ring gear meshes with a plurality of first planetary gears, the plurality of first planetary gears are connected to one side of an output gear, another side of the output gear is provided with a driven toothed portion, the driven toothed portion meshes with a plurality of second planetary gears, the plurality of second planetary gears mesh with an inner annular wall of a second ring gear, the plurality of second planetary gears are connected to one side of a worm shaft, another side of the worm shaft is connected to a worm, a circumferential side of the worm is connected with one side of a worm gear, and another side of the worm gear is connected with the belt winding unit.

8. The power device for a pneumatic packing tool, as claimed in claim 1, wherein the transmission unit has a housing, the housing is provided with two screws for locking the pneumatic packing tool, the two screws are socket head cap screws, and the two screws are perpendicular to an axis of the transmission unit.

* * * * *